US010269552B2

(12) United States Patent
Ziegler et al.

(10) Patent No.: US 10,269,552 B2
(45) Date of Patent: Apr. 23, 2019

(54) GAS DISCHARGE LAMP AND A DEVICE FOR CONTROLLING THE TEMPERATURE THEREOF

(71) Applicant: ZED ZIEGLER ELECTRONIC DEVICES GMBH, Langewiesen (DE)

(72) Inventors: Karin Ziegler, Oehrenstock (DE); Rolf Ziegler, Oehrenstock (DE)

(73) Assignee: ZED ZIEGLER ELECTRONIC DEVICES GMBH, Langewiesen (DE)

( * ) Notice: Subject to any disclaimer, the term of this patent is extended or adjusted under 35 U.S.C. 154(b) by 16 days.

(21) Appl. No.: 15/575,731

(22) PCT Filed: May 10, 2016

(86) PCT No.: PCT/EP2016/060386
§ 371 (c)(1),
(2) Date: Nov. 20, 2017

(87) PCT Pub. No.: WO2016/184716
PCT Pub. Date: Nov. 24, 2016

(65) Prior Publication Data

US 2018/0144924 A1 May 24, 2018

(30) Foreign Application Priority Data

May 18, 2015 (DE) ..... 10 2015 107 694

(51) Int. Cl.
*H01J 61/24* (2006.01)
*H01J 61/28* (2006.01)
(Continued)

(52) U.S. Cl.
CPC ..... *H01J 61/523* (2013.01); *H01J 61/24* (2013.01); *H01J 61/28* (2013.01); *H01J 61/72* (2013.01)

(58) Field of Classification Search
CPC ..... H01J 61/523; H01J 61/24; H01J 61/28; H01J 61/72
(Continued)

(56) References Cited

U.S. PATENT DOCUMENTS 5,019,751 A * 5/1991 Flory, IV ..... H05B 37/03 315/119
5,095,336 A 3/1992 Corona et al.
(Continued)

FOREIGN PATENT DOCUMENTS

DE 102004009995 A1 9/2005
DE 10 2006 023 870 B3 6/2007
(Continued)

OTHER PUBLICATIONS

International Search Report dated Oct. 14, 2016 issued in connection with corresponding International Application No. PCT/EP2016/060386 (3 pages total).

*Primary Examiner* — Don P Le
(74) *Attorney, Agent, or Firm* — Karin L. Williams; Mayer & Williams PC

(57) ABSTRACT

The present invention relates to a device for the regulated temperature control of a gas discharge lamp, and a gas discharge lamp. The device according to the invention includes a transformer core of a transformer, the transformer core being designed for accommodating at least one discharge current-conducting connecting line of the gas discharge lamp as a primary winding. The transformer forms an energy source for heating a functional area of the gas discharge lamp that determines a function of the gas discharge lamp, and that is formed by an amalgam reservoir. The device also includes a secondary winding on the transformer core, and a means for temperature control that is used to regulate the energy that heats the amalgam reservoir. The
(Continued)

means for temperature control is electrically connected to the secondary winding.

20 Claims, 2 Drawing Sheets

(51) Int. Cl.
*H01J 61/52* (2006.01)
*H01J 61/72* (2006.01)
*H01J 65/04* (2006.01)

(58) Field of Classification Search
USPC ..... 315/116
See application file for complete search history.

(56) References Cited

U.S. PATENT DOCUMENTS 6,175,197 B1 1/2001 Kling
7,095,167 B2 8/2006 Pirovic
2007/0145880 A1* 6/2007 Jansen ..... H01J 61/20 313/490
2010/0134023 A1* 6/2010 Mills ..... H05B 41/3922 315/174
2012/0019169 A1 1/2012 Voronov et al.
2012/0112637 A1* 5/2012 Rooijackers ..... H05B 41/282 315/117
2013/0020942 A1 1/2013 Voronov
2013/0099664 A1* 4/2013 Kumar ..... H01J 61/28 315/39.71
2014/0091713 A1* 4/2014 Hyde ..... H05B 41/295 315/115

FOREIGN PATENT DOCUMENTS

DE 10 2006 033672 A1 1/2008
DE 20 2004 021 717 U1 7/2010
DE 10 2009 014 942 B3 8/2010
DE 10 2010 014 040 B4 10/2011
EP 1 609 170 B1 12/2005
EP 2 447 981 A1 5/2012
JP 61-227358 A 10/1986
JP 2003-249192 A 9/2003
WO 03/045117 A1 5/2003
WO 2003/060950 A2 7/2003
WO 2006/122394 A1 11/2006
WO 2008009571 A2 1/2008

* cited by examiner

GAS DISCHARGE LAMP AND A DEVICE FOR CONTROLLING THE TEMPERATURE THEREOF

FIELD

The present invention relates firstly to a device for the regulated temperature control of at least a portion of a gas discharge lamp, for example for the regulated heating of an amalgam reservoir of a low-pressure mercury vapor lamp. The invention further relates to a gas discharge lamp.

BACKGROUND

EP 1 609 170 B1 discloses a low-pressure mercury vapor discharge lamp that includes an elongated glass tube with an amalgam container. The amalgam container is open toward the interior of the glass tube, and is attached to the outer wall surface next to a pressed end of the glass tube.

A UV radiation lamp having a closed cavity which includes a mercury-containing material and at least one electrode is known from WO 2006/122394 A1. A controllable heating unit is situated outside the cavity, but in contact with the cavity.

EP 2 447 981 B1 teaches a lamp system having a low-pressure mercury vapor discharge lamp, which includes a discharge vessel that encloses a filling of mercury and a noble gas, and two electrodes at the end sections. An amalgam having an optimal temperature range is situated at the pressed first end section, outside the discharge path. The amalgam is heatable via a heating element. An electronic circuit generates the discharge current, and the heating current for the heating element. A control circuit connected to a temperature sensor generates a control signal for activating the heating current.

WO 2003/060950 A2 discloses a mercury low-pressure amalgam irradiator, in which the amalgam is heatable by a heating element that is formed by a PTC resistor.

A method for operating an amalgam lamp is known from DE 10 2010 014 040 B4, in which a discharge chamber is available for an amalgam reservoir. The amalgam reservoir is heatable by means of a heating element.

DE 10 2009 014 942 B3 teaches a dimmable amalgam lamp having a quartz glass tube which envelops a discharge chamber containing a filling gas. The quartz glass tube is closed on both ends with crimpings, through which at least one bushing for a helical electrode in each case is guided into the discharge chamber. At least one of the crimpings has a cavity, with an opening to the discharge chamber, for accommodating an amalgam reservoir that is temperature-controllable by means of the helical electrode.

DE 10 2006 023 870 B3 discloses an arrangement of a mercury low-pressure amalgam lamp with an amalgam reservoir and a cladding tube that encloses this lamp. In the area of the amalgam reservoir the lamp is annularly surrounded by a nonmetallic band that rests against the lamp.

An electronic ballast for a gas discharge lamp is known from WO 03/045117 A1, in which the heating power is supplied to at least one electrode via a transformer.

U.S. Pat. No. 5,095,336 discloses an amalgam lamp in which the amalgam is distributed over multiple positions in the amalgam lamp, and is heatable via sleeve segment-shaped heating elements. The heating elements are connected to a specialized controller that is fed by a ballast.

DE 20 2004 021 717 U1 discloses a circuit system for operating a gas discharge lamp, having a heating transformer for heating the lamp filaments. The heating transformer is made up of a primary winding and two secondary windings, each situated within two heating circuits, in series with respect to the two lamp filaments. The primary winding is situated within an intermediate circuit that is fed by the load circuit. In dimming mode, a required adaptation of the heating power takes place by changing the impedance of the intermediate circuit, via which a heating current is coupled into the two lamp filaments. The feeding of the intermediate circuit by the load circuit takes place with an inductive coupling, for which purpose a coupling transformer, made up of a primary winding situated in the load circuit and a secondary winding situated in the intermediate circuit, is provided. The intermediate circuit includes a capacitor that is bridgeable by a controllable switch. The heating power is changed, depending on whether or not the capacitor is bridged.

WO 03/060950 A2 discloses a mercury low-pressure amalgam irradiator having an amalgam reservoir. A means for influencing the temperature of the amalgam is provided, and is formed by an electrical heating element, for example. The electrical heating element is fed by an operating voltage of the irradiator.

SUMMARY

Proceeding from the prior art, the object of the present invention is to make it possible to achieve the regulated temperature control of gas discharge lamps with less effort.

The stated object is achieved by a device according to appended claim 1, and by a gas discharge lamp according to appended independent claim 10.

The device according to the invention is used for the regulated temperature control of at least a portion of a gas discharge lamp, in particular the regulated temperature control of a functional area of the gas discharge lamp that determines a function of the gas discharge lamp. As a result, the function of the gas discharge lamp, i.e., the emission during the gas discharge, is dependent on the temperature of the functional area. Thus, the function of the gas discharge lamp is also determined by the temperature of the functional area of the gas discharge lamp.

The device according to the invention includes a transformer core of an electrical transformer. The transformer core is designed for accommodating at least one connecting line of the gas discharge lamp. The at least one connecting line conducts at least a portion of a discharge current of the gas discharge lamp. The connecting line to be led through the transformer core, or the connecting lines to be led through the transformer core, in each case thus form a primary winding of the transformer.

The transformer is used as an energy source for heating the functional area of the gas discharge lamp. The energy that is introducible into the transformer via the primary winding or via the primary windings is thus utilized for heating the functional area.

The device according to the invention also includes at least one secondary winding on the transformer core. Electrical energy that is introducible into the transformer via the primary winding or via the primary windings may be tapped via the secondary winding or via the secondary windings.

The device according to the invention also includes a means for temperature control, which is used for regulating the energy that heats the functional area. The means for temperature control is electrically connected to the secondary winding to allow the means for temperature control to be fed with electrical energy. In the simplest case, the means for temperature control is directly connected to the secondary winding. Alternatively, the means for temperature control may be indirectly connected to the secondary winding via a power supply circuit.

One particular advantage of the device according to the invention is that it requires no additional energy supply, i.e., no additional electrical lines, for heating the functional area of the gas discharge lamp; instead, the energy necessary for heating the functional area is withdrawn from the energy that is provided for the gas discharge.

In a first group of preferred embodiments of the device according to the invention, the device also includes a temperature sensor for measuring the temperature of the functional area. The temperature sensor is preferably used for directly or indirectly measuring the temperature of the functional area. The indirect measurement of the temperature of the functional area may take place, for example, by connecting the temperature sensor to the functional area via a heat conductor. The means for temperature control is formed by a temperature control electronics system. The temperature sensor is electrically connected to the temperature control electronics system, so that the temperature at the functional area is controllable by the temperature control electronics system. The temperature control electronics system is preferably designed for controlling the temperature, measured with the temperature sensor, to a predefined constant value. The temperature sensor may be directly or indirectly electrically connected to the temperature control electronics system. The device according to the invention may be designed in such a way that the temperature sensor is directly mountable at the functional area. However, the device according to the invention may also be designed in such a way that the temperature sensor is mountable at a distance from the functional area, a heat-conducting element being situated between the temperature sensor and the functional area, so that the temperature at the temperature sensor is virtually the same as that at the functional area.

In a first subgroup of the first group of preferred embodiments of the device according to the invention, the device also includes an electrical heating element for heating the functional area, and which is electrically connected to the temperature control electronics system. Controlled operation of the electrical heating element is thus made possible. The electrical heating element may be directly electrically connected to the temperature control electronics system. However, the electrical heating element is preferably indirectly electrically connected to the temperature control electronics system via a power controller. The electrical heating element is preferably formed by a heating resistor, but may also be formed by an electronic component whose heat loss results in a heating effect.

The device according to the invention may be designed in such a way that the electrical heating element is directly mountable at the functional area. However, the device according to the invention may also be designed in such a way that the electrical heating element is mountable at a distance from the functional area, a heat-conducting element being situated between the electrical heating element and the functional area, so that at least a portion of the heat that is generatable by the electrical heating element is transferable to the functional area to the greatest extent possible.

In a second subgroup of the first group of preferred embodiments of the device according to the invention, the transformer core is designed for heating the functional area, for which purpose the transformer core is heat-conductively connected to the functional area, and for which purpose the device also includes an electronic switch that is controllable by the temperature control electronics system and that is electrically connected to the secondary winding. The electronic switch is connected in parallel to the secondary winding. When the electronic switch is open, i.e., high-resistance, the alternating current flowing through the primary winding causes a continual reverse magnetization of the transformer core, with the associated reverse magnetization losses, which heat the transformer core and thus the functional area. When the electronic switch is closed, i.e., low-resistance, the voltage at the secondary winding is very small or virtually zero, so that, despite the alternating current flowing through the primary winding, only negligible reverse magnetization of the transformer core, with the associated reverse magnetization losses, occurs, and the transformer core is heated very little.

The device according to the invention may be designed in such a way that the transformer core is directly mountable at the functional area. However, the device according to the invention may also be designed in such a way that the transformer core is mountable at a distance from the functional area, a heat-conducting element being situated between the transformer core and the functional area, so that the heat that is generatable by the transformer core is at least partially transferable to the functional area.

The electronic switch is preferably formed by one or more transistors. The multiple transistors are preferably connected in parallel or in series. However, the electronic switch may also be formed by other electronic components, for example a TRIAC.

The electronic switch preferably has exactly two switching states, namely, an open switching state and a closed switching state. In the open switching state the electronic switch is high-resistance. In the closed switching state the electronic switch is essentially short-circuited, i.e., low-resistance. In modified embodiments, the electronic switch may also have further switching states, for example with an average resistance value.

In preferred embodiments of the device according to the invention, the device also includes a power supply circuit, which on the input side is connected to the secondary winding and on the output side is connected to the temperature control electronics system. The power supply circuit is used to convert the alternating voltage present at the secondary winding into a supply voltage for the temperature control electronics system. This supply voltage is preferably formed by a stabilized direct voltage, but may also be formed an unstabilized direct voltage.

In the above-described first subgroup of the first group of preferred embodiments, which include the heating element, the alternating voltage present at the secondary winding is also used for operating the heating element, for which purpose the supply voltage provided by the power supply circuit is preferably used.

In the above-described second subgroup of the first group of preferred embodiments, in which the transformer core is designed for heating the functional area, the power supply circuit preferably includes an electrical energy store. The electrical energy store is used for supplying the temperature control electronics system during those time intervals in which the secondary winding is short-circuited, i.e., switched to low resistance, by the electronic switch, and therefore no electrical energy can be tapped from the secondary winding.

In preferred embodiments of the device according to the invention, the temperature sensor is connected to the temperature control electronics system via a temperature measurement electronics system. The temperature measurement electronics system is used for operating the temperature sensor and/or for processing the measuring signal of the temperature sensor.

In a second group of preferred embodiments of the device according to the invention, the means for temperature control is formed by a heat-conducting resistor which is heat-conductively connected to the functional area. The transformer core is preferably designed for heating the functional area, for which purpose the transformer core is heat-conductively connected to the functional area. The heat-conducting resistor is preferably directly connected to the at least one secondary winding. The heat-conducting resistor determines the ohmic load on the at least one secondary winding. When the temperature of the functional area increases, the electrical resistance of the heat-conducting resistor decreases, so that the voltage at the secondary winding drops, resulting in reduced reverse magnetization of the transformer core, causing the reverse magnetization losses to drop and the transformer core to be heated less.

In particular embodiments of the device according to the invention, the device also includes an electrical cooling element for cooling the functional area, and which is electrically connected to the temperature control electronics system. Thus, depending on the temperature to be achieved, the functional area may be heated by use of the transformer core or the heating element, or cooled by use of the cooling element. The electrical cooling element may be directly electrically connected to the temperature control electronics system. However, the electrical cooling element is preferably indirectly electrically connected to the temperature control electronics system via a power controller. The device according to the invention may be designed in such a way that the electrical cooling element is directly mountable at the functional area. However, the device according to the invention may also be designed in such a way that the electrical cooling element is mountable at a distance from the functional area, a heat-conducting element being situated between the electrical cooling element and the functional area, so that the heat that is dissipatable by the electrical cooling element is at least partially transferable from the functional area.

In further particular embodiments, the described cooling function is implemented in that the heating element is formed by a combined heating and cooling element. The combined heating and cooling element is preferably formed by a Peltier element.

The transformer core is preferably made of a high-permeability material, and preferably has a ring-shaped design. The transformer core is preferably formed from ring-shaped ferrite, by a cut strip-wound core, or by a toroidal core.

The transformer core is preferably designed for accommodating exactly one of the connecting lines of the gas discharge lamp that conducts the discharge current, provided that the gas discharge lamp has exactly one connecting line at each of the electrodes. For this purpose, the transformer core has exactly one open through opening through which the connecting line is to be led in order to form the primary winding. Alternatively, the transformer core is preferably designed for accommodating the two connecting lines of one of the electrodes of the gas discharge lamp, provided that the gas discharge lamp has two connecting lines at each of the electrodes. For this purpose, the transformer core has one or two open through openings through which the two connecting lines are to be led in order to form the two primary windings.

In principle, the one or more connecting lines to be led through in each case form(s) a primary winding of the transformer.

The device according to the invention is preferably designed in such a way that the one or more connecting lines to be led through may be passed through the transformer core, so that the primary winding to be formed or the primary windings to be formed in each case has/have exactly one winding. Alternatively, the device according to the invention may be designed in such a way that the one or more connecting lines to be led through is/are multiply windable around the transformer core, so that the primary winding to be formed or the primary windings to be formed each has/have multiple windings.

The device according to the invention is preferably designed in such a way that the multiple connecting lines to be led through may be passed through the transformer core in the same direction or are windable in the same direction around the transformer core, so that the primary windings to be formed have the same winding direction. As a result, for example a current which for heating the particular electrode flows through one connecting line and back through the other connecting line does not result in an induced voltage in the secondary winding.

The secondary winding preferably has multiple windings.

The functional area is preferably formed by an amalgam reservoir in which preferably one or more amalgams or also one or more other mercury compounds or mercury is/are present. An amalgam composition, for example BiSnHg and BiSnInHg, is preferably present in the amalgam reservoir. These type of amalgam reservoirs are known from the prior art in so-called amalgam lamps, which are low-pressure mercury vapor lamps with doping, in which an additional material such as indium lowers the mercury vapor pressure and thus allows a higher output of the gas discharge lamp formed by a low-pressure mercury vapor lamp.

However, the functional area may also be formed by some other area of the gas discharge lamp whose temperature influences the gas discharge, for example in the vicinity of the electrodes.

The amalgam reservoir is preferably formed by a glass tube that is closed on one side, and which is provided at an axial end of the gas discharge lamp. The glass tube is provided at the glass bulb that encloses the mercury vapor.

The device according to the invention also preferably includes a sleeve made of a heat-conducting material that is pushable onto the amalgam reservoir formed by the glass tube. The sleeve allows simple installation of the device according to the invention on the gas discharge lamp. During this installation, the sleeve is pushed onto the glass tube, resulting in good thermal coupling to the functional area that is formed by the glass tube.

In the above-described first subgroup of the first group of preferred embodiments, which include the heating element, the heating element is preferably situated on the sleeve and heat-conductively connected to same. In the above-described embodiments in which the transformer core is designed for heating the functional area, the sleeve is preferably heat-conductively connected to the transformer core.

The temperature sensor is likewise preferably situated on the sleeve or on the heat-conducting element situated between the functional area and the transformer core, and is heat-conductively connected to this sleeve or to this element.

The sleeve is preferably made of copper, a copper alloy, or aluminum.

Alternatively, the amalgam reservoir is preferably formed by a pocket that is provided at an axial end of the gas discharge lamp, in particular within a pressed-together axial end of the glass bulb that encloses the mercury vapor.

Alternatively, the amalgam reservoir is preferably formed by a partial surface of an inner wall of the glass bulb of the gas discharge lamp that encloses the mercury vapor, at which a quantity of amalgam is situated by adhesion.

The device according to the invention also preferably includes a strip-like heat conductor that is pushable onto the amalgam reservoir that is formed in particular by the pocket or by the partial surface of the inner wall of the glass bulb. The strip-like heat conductor may be designed as a clamp, for example.

In preferred embodiments of the device according to the invention, the device also includes a support element to which the transformer core together with the secondary winding, the temperature control electronics system, and the temperature sensor is fastened or at least fixed, or on which it is at least supported. The support element is designed to be fastened at an axial end of the gas discharge lamp.

If the device according to the invention also includes the described sleeve, the described heating element, the described power supply circuit, and/or the described temperature measurement electronics system, these are likewise preferably fastened to the support element.

The support element preferably has at least one through opening for leading through in each case one of the at least one connecting line of the gas discharge lamp. When the particular connecting line is led through the through opening of the support element, the connecting line in question is also led through the transformer core, so that a primary winding of the transformer is formed. Therefore, the at least one through opening is preferably designed in such a way that the particular connecting line forms a primary winding of the transformer due to leading through one of the connecting lines of the gas discharge lamp. The support element preferably has two of the through openings, each of which is designed for leading through one of the two connecting lines of one of the electrodes of the gas discharge lamp.

The support element is preferably formed by a molded part that accommodates the mentioned components of the device according to the invention with a precise fit. The support element preferably includes a protective sleeve that rests on the outside of the support element.

The gas discharge lamp according to the invention includes, firstly, a cavity that is filled with a dischargeable gas. Situated in the cavity are two electrodes, each of which is electrically connected to at least one connecting line for conducting a discharge current. The gas discharge lamp according to the invention has a functional area that determines a function of the gas discharge lamp, and whose temperature influences the function of the gas discharge lamp. The gas discharge lamp according to the invention also includes the device according to the invention for the regulated temperature control of the gas discharge lamp. At least one of the connecting lines forms a primary winding of the transformer of the device for the regulated temperature control. This at least one connecting line is led through the transformer core or wound onto same.

The gas discharge lamp according to the invention is preferably a low-pressure mercury vapor lamp.

The gas discharge lamp according to the invention is preferably designed for emitting UV radiation.

The gas discharge lamp according to the invention preferably includes a glass tube or a glass bulb in which the cavity is formed. The electrodes are in each case situated at one of the closed axial ends of the glass tube or of the glass bulb.

The device for the regulated temperature control of the gas discharge lamp is preferably situated at one of the two axial ends of the glass tube or of the glass bulb. The device for the regulated temperature control preferably has an external shape that axially extends the external shape of the glass tube or of the glass bulb.

The device for the regulated temperature control is preferably fixedly connected to the glass tube or to the glass bulb. The device for the regulated temperature control and the glass tube or the glass bulb thus form a structural unit that is preferably inseparable. The fixed connection is preferably established between the support element of the device for the regulated temperature control and the glass tube or the glass bulb.

The gas discharge lamp according to the invention preferably includes one of the above-described preferred embodiments of the device according to the invention for the regulated temperature control of the gas discharge lamp. In particular, the gas discharge lamp according to the invention preferably also has those features described in conjunction with the device according to the invention for the regulated temperature control of the gas discharge lamp.

The temperature sensor is preferably situated directly at the functional area. Alternatively, the temperature sensor is preferably situated at a distance from the functional area, a heat-conducting element being situated between the temperature sensor and the functional area, so that the temperature at the temperature sensor is virtually the same as that at the functional area.

In the above-described first subgroup of the first group of preferred embodiments of the device according to the invention, the device also includes the electrical heating element for heating the functional area of the gas discharge lamp. The electrical heating element is preferably situated directly at the functional area of the gas discharge lamp. Alternatively, the electrical heating element is preferably situated at a distance from the functional area of the gas discharge lamp, a heat-conducting element being situated between the electrical heating element and the functional area of the gas discharge lamp, so that the heat that is generatable by the electrical heating element is at least partially transferable to the functional area of the gas discharge lamp.

In some of the above-described embodiments of the device according to the invention, the transformer core is designed for heating the functional area of the gas discharge lamp. The transformer core is preferably situated directly at the functional area of the gas discharge lamp. Alternatively, the transformer core is preferably situated at a distance from the functional area of the gas discharge lamp, a heat-conducting element being situated between the transformer core and the functional area of the gas discharge lamp, so that the heat that is generatable by the transformer core is at least partially transferable to the functional area of the gas discharge lamp.

In the above-described particular embodiments of the device according to the invention, the device also includes the electrical cooling element. The electrical cooling element is preferably situated directly at the functional area of the gas discharge lamp. Alternatively, the electrical cooling element is preferably situated at a distance from the functional area of the gas discharge lamp, a heat-conducting element being situated between the electrical cooling element and the functional area of the gas discharge lamp, so that the heat that is dissipatable by the electrical cooling element is at least partially transferable from the functional area of the gas discharge lamp.

Preferably exactly one of the connecting lines of the gas discharge lamp conducting the discharge current is led through the transformer core, provided that the gas discharge lamp has exactly one connecting line at each of the electrodes. The two connecting lines of one of the electrodes of the gas discharge lamp are preferably led through the transformer core, provided that the gas discharge lamp has two connecting lines at each of the electrodes. In principle, the one or more connecting lines led through the transformer core in each case form(s) a primary winding of the transformer.

The one or more led-through connecting lines is/are preferably passed through the transformer core, so that the one primary winding or the multiple primary windings in each case has/have exactly one winding. Alternatively, the one or more led-through connecting lines is/are multiply wound around the transformer core, so that the one primary winding or the multiple primary windings in each case has/have multiple windings.

The multiple connecting lines are preferably led through the transformer core in the same direction or are wound in the same direction around the transformer core, so that the primary windings have the same winding direction.

One of the above-described embodiments of the device according to the invention includes the described sleeve. The sleeve preferably rests on the amalgam reservoir formed by the glass tube. The sleeve is pushed onto the glass tube, resulting in good thermal coupling to the functional area that is formed by the glass tube.

BRIEF DESCRIPTION OF THE DRAWINGS

Further advantages, particulars, and refinements of the invention result from the following description of two preferred embodiments of the invention, with reference to the drawings, which show the following.

DETAILED DESCRIPTION

Figure 1:
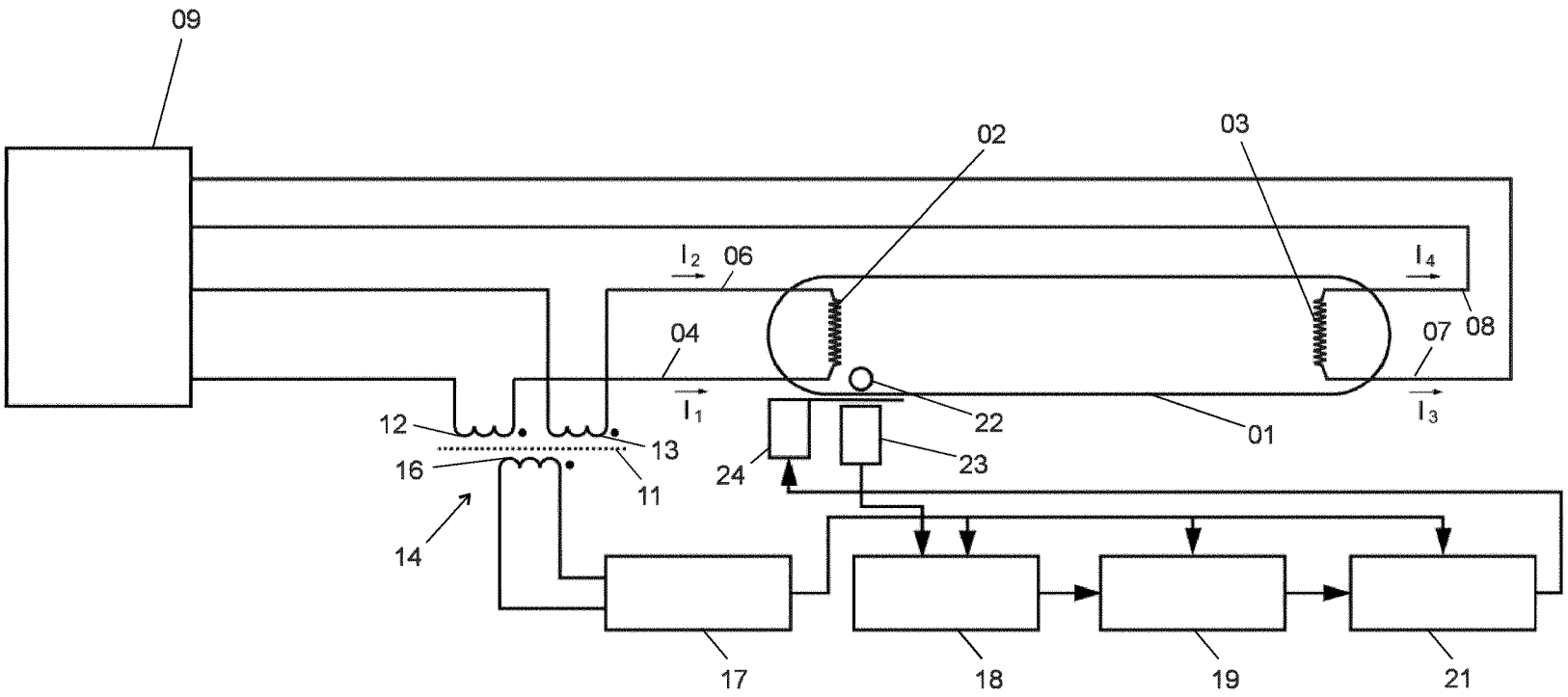
FIG. 1 shows a schematic illustration of a first preferred embodiment of a gas discharge lamp according to the invention.

FIG. 1 shows a schematic illustration of a first preferred embodiment of a gas discharge lamp according to the invention. The gas discharge lamp is formed by a low-pressure mercury vapor lamp, and includes a glass tube 01 in which mercury vapor (not illustrated) is present. The glass tube 01 is closed at its two axial ends. A first electrode 02 is situated at one of the two axial ends of the glass tube 01, while a second electrode 03 is situated at the other of the two axial ends of the glass tube 01. The two electrodes 02, 03 are situated in the interior of the glass tube 01. The first electrode 02 is connected via a first connecting line 04 and via a second connecting line 06. In addition, the second electrode 03 is connected via a first connecting line 07 and via a second connecting line 08. The two connecting lines 04, 06 of the first electrode 02 and the two connecting lines 07, 08 of the second electrode 03 are connected to a ballast 09. The ballast 09 provides a discharge current for operating the gas discharge lamp, which results in the gas discharge and thus, the emission of UV radiation. In addition, in an operation start phase the ballast 09 provides a heating current for heating the two electrodes 02, 03. The currents flowing through the four connecting lines 04, 06, 07, 08 are respectively denoted by reference characters currents $I_1$, $I_2$, $I_3$, $I_4$ in the illustration.

The two connecting lines 04, 06 of the first electrode 02 are led through a transformer core 11, where they form a first primary winding 12 and a second primary winding 13 of a transformer 14. The transformer 14 also includes a secondary winding 16 on the transformer core 11. The two primary windings 12, 13 have the same winding direction.

The secondary winding 16 feeds a power supply circuit 17 that is used for converting the alternating voltage that is present at the secondary winding 16. The power supply circuit 17 supplies a temperature measurement electronics system 18, a temperature control electronics system 19, and a power controller 21 with electrical energy.

Situated in the glass tube 01 of the gas discharge lamp is an amalgam reservoir 22, in which an amalgam composition (not illustrated) is present. The temperature of the amalgam composition influences the gas discharge in the gas discharge lamp, so that the amalgam reservoir 22 represents a functional area of the gas discharge that influences the function of the gas discharge lamp.

A temperature sensor 23 for measuring the temperature of the amalgam reservoir 22, and an electrical heating element 24 for heating the amalgam reservoir 22, are situated at the amalgam reservoir 22, outside the glass tube 01.

The temperature sensor 23 is electrically connected to the temperature measurement electronics system 18, which in turn is electrically connected to the temperature control electronics system 19, so that a temperature measuring signal is available in the temperature control electronics system 19. The temperature control electronics system 19 is also electrically connected to the power controller 21, via which the electrical heating element 24 receives electrical energy.

Figure 2:
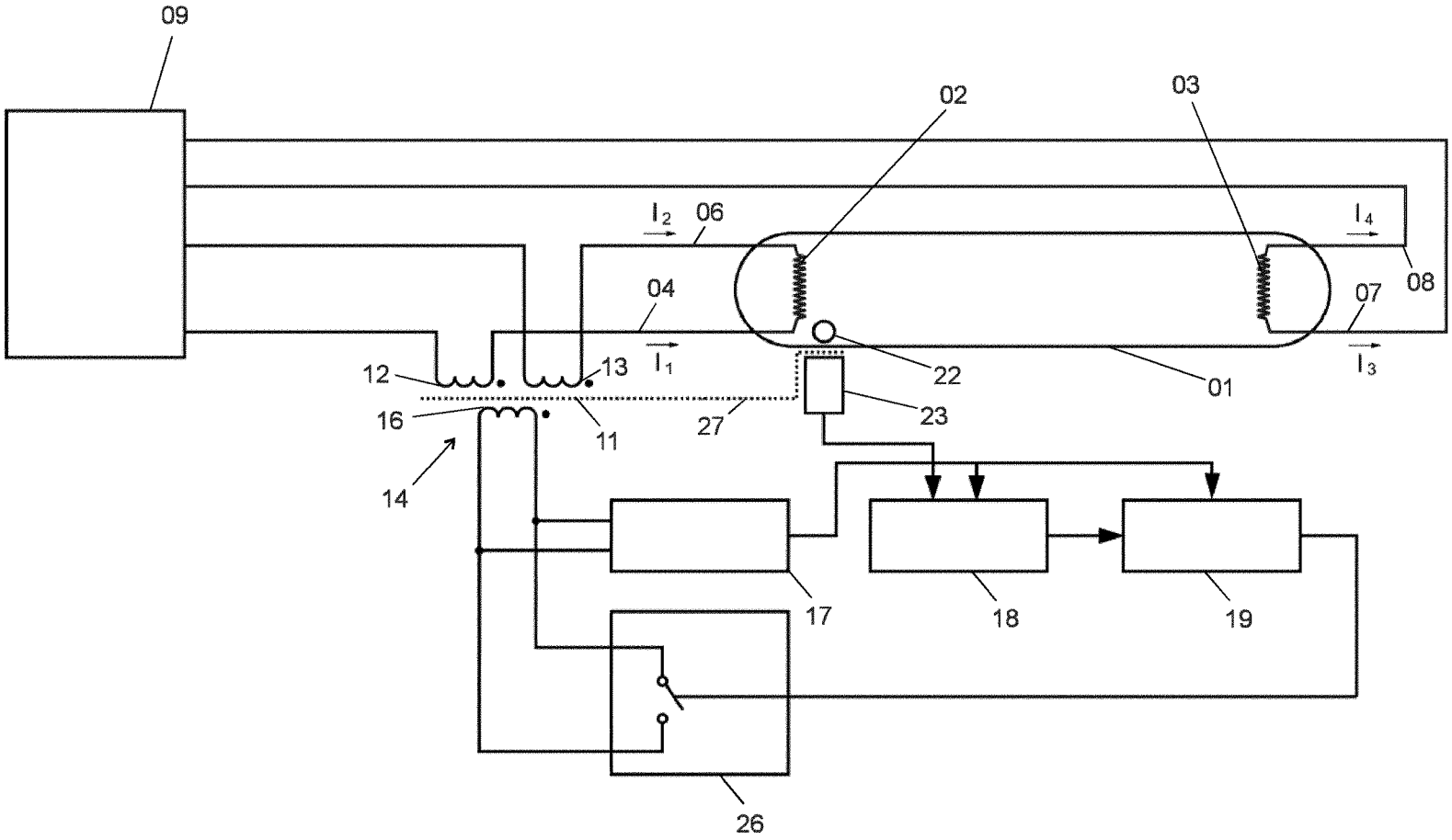
FIG. 2—shows a schematic illustration of a second preferred embodiment of the gas discharge lamp according to the invention.

FIG. 2 shows a schematic illustration of a second preferred embodiment of the gas discharge lamp according to the invention. This second embodiment is similar to the first embodiment shown in FIG. 1. In contrast to the first embodiment shown in FIG. 1, the second embodiment does not have the electrical heating element 24 and the power controller 21. Instead, the temperature control electronics system 19 is electrically connected to an electronic switch 26, via which the secondary winding 16 may be short-circuited. Another difference from the first embodiment shown in FIG. 1 is that the transformer core 11 is heat-conductively connected to the amalgam reservoir 22 via a thermal coupling 27, so that heat generated by the transformer core 11 is partially transferred to the amalgam reservoir 22.

LIST OF REFERENCE NUMERALS

01 glass tube
02 first electrode
03 second electrode
04 first connecting line of the first electrode
05 -
06 second connecting line of the first electrode
07 first connecting line of the second electrode
08 second connecting line of the second electrode
09 ballast
10 -
11 transformer core
12 first primary winding
13 second primary winding
14 transformer

15 -
16 secondary winding
17 power supply circuit
18 temperature measurement electronics system
19 temperature control electronics system
20 -
21 power controller
22 amalgam reservoir
23 temperature sensor
24 electrical heating element
25 -
26 electronic switch
27 thermal coupling

The invention claimed is:

1. A device for the regulated temperature control of a gas discharge lamp, comprising:

a transformer core of a transformer, the transformer core being designed for accommodating at least one discharge current-conducting connecting line of the gas discharge lamp as a primary winding, the transformer forming an energy source for heating a functional area of the gas discharge lamp that determines a function of the gas discharge lamp, and the functional area being formed by an amalgam reservoir;

a secondary winding on the transformer core; and a means for temperature control that is used to regulate the energy that heats the amalgam reservoir, the means for temperature control being electrically connected to the secondary winding.

2. The device according to claim 1, wherein the means for temperature control is formed by a temperature control electronics system, and also includes a temperature sensor for directly or indirectly measuring the temperature of the amalgam reservoir, the temperature sensor being electrically connected to the temperature control electronics system.

3. The device according to claim 2, wherein the device also includes an electrical heating element for heating the amalgam reservoir, and which is electrically connected to the temperature control electronics system.

4. The device according to claim 2, wherein the transformer core is designed for heating the amalgam reservoir, for which purpose the transformer core is heat-conductively connected to the amalgam reservoir, and for which purpose the device also includes an electronic switch that is controllable by the temperature control electronics system and that is electrically connected to the secondary winding.

5. The device according to claim 2, wherein the device also includes a power supply circuit, which on the input side is connected to the secondary winding and on the output side is connected to the temperature control electronics system.

6. The device according to claim 2, wherein the device also includes a sleeve that is made of a heat-conducting material and is pushable onto the amalgam reservoir.

7. The device according to claim 1, wherein the means for temperature control is formed by a heat-conducting resistor that is heat-conductively connected to the amalgam reservoir.

8. The device according to claim 1, wherein the device also includes a sleeve that is made of a heat-conducting material and is pushable onto the amalgam reservoir.

9. The device according to claim 3, wherein the transformer core is designed for heating the amalgam reservoir, for which purpose the transformer core is heat-conductively connected to the amalgam reservoir, and for which purpose the device also includes an electronic switch that is controllable by the temperature control electronics system and that is electrically connected to the secondary winding.

10. The device according to claim 3, wherein the device also includes a power supply circuit, which on the input side is connected to the secondary winding and on the output side is connected to the temperature control electronics system.

11. The device according to claim 4, wherein the device also includes a power supply circuit, which on the input side is connected to the secondary winding and on the output side is connected to the temperature control electronics system.

12. The device according to claim 11, wherein the power supply circuit includes an electrical energy store.

13. The device according to claim 3, wherein the device also includes a sleeve that is made of a heat-conducting material and is pushable onto the amalgam reservoir.

14. The device according to claim 4, wherein the device also includes a sleeve that is made of a heat-conducting material and is pushable onto the amalgam reservoir.

15. The device according to claim 5, wherein the device also includes a sleeve that is made of a heat-conducting material and is pushable onto the amalgam reservoir.

16. The device according to claim 12, wherein the device also includes a sleeve that is made of a heat-conducting material and is pushable onto the amalgam reservoir.

17. The device according to claim 14, wherein the sleeve is heat-conductively connected to the transformer core.

18. The device according to claim 7, wherein the device also includes a sleeve that is made of a heat-conducting material and is pushable onto the amalgam reservoir.

19. A gas discharge lamp comprising the following components:

a cavity filled with a dischargeable gas;

two electrodes in the cavity, each having at least one connecting line for conducting a discharge current;

a functional area that determines a function of the gas discharge lamp, and that is formed by an amalgam reservoir; and a device for the regulated temperature control of the gas discharge lamp including: a transformer core of a transformer, the transformer core being designed for accommodating at least one discharge current-conducting connecting line of the gas discharge lamp as a primary winding, the transformer forming an energy source for heating a functional area of the gas discharge lamp that determines a function of the gas discharge lamp, and the functional area being formed by an amalgam reservoir;

a secondary winding on the transformer core; and a means for temperature control that is used to regulate the energy that heats the amalgam reservoir, the means for temperature control being electrically connected to the secondary winding, wherein at least one of the connecting lines is designed as a primary winding of the transformer.

20. A gas discharge lamp according to claim 19 wherein the means for temperature control is formed by—a temperature control electronics system, and also includes a temperature sensor for directly or indirectly measuring the temperature of the amalgam reservoir, the temperature sensor being electronically connected to the temperature control electronics system.

* * * * *